US005335597A

United States Patent [19]

Helmstädter

[11] Patent Number: 5,335,597

[45] Date of Patent: Aug. 9, 1994

[54] METHOD AND DEVICE FOR STARTING AND STOPPING A SHEET TURNING OPERATION AND FOR FORMAT ADJUSTING DURING SHEET TRANSPORT THROUGH A PRINTING PRESS

[75] Inventor: Karl-Heinz Helmstädter, Snh-Adersbach, Fed. Rep. of Germany

[73] Assignee: Heidelberger Druckmaschinen AG, Heidelberg, Fed. Rep. of Germany

[21] Appl. No.: 91,967

[22] Filed: Jul. 15, 1993

[30] Foreign Application Priority Data

Jul. 15, 1992 [DE] Fed. Rep. of Germany ..... 4223188
Jul. 6, 1993 [DE] Fed. Rep. of Germany ..... 4322477

[51] Int. Cl.[5] ..... B41F 5/02

[52] U.S. Cl. ..... 101/485; 101/142; 101/183; 101/230; 101/410; 101/247; 271/82

[58] Field of Search ..... 101/485, 142, 183, 230, 101/410–411, 247, 248; 271/82

[56] References Cited

U.S. PATENT DOCUMENTS

| | | | |
|---|---|---|---|
| 3,772,990 | 11/1973 | Weisgerber | 101/230 |
| 4,014,261 | 3/1977 | Becker . | |
| 4,122,773 | 10/1978 | Wirz . | |
| 4,457,231 | 7/1984 | Kawaguchi | 101/230 |
| 4,530,283 | 7/1985 | Mathes et al. | 101/410 |
| 4,821,643 | 4/1989 | Wieland | 101/230 |
| 5,031,531 | 7/1991 | Becker . | |
| 5,033,379 | 7/1991 | Becker . | |
| 5,076,164 | 12/1991 | Becker . | |
| 5,085,143 | 2/1992 | Becker . | |
| 5,105,737 | 4/1992 | Becker . | |

FOREIGN PATENT DOCUMENTS

| | | |
|---|---|---|
| 2419747 | 11/1975 | Fed. Rep. of Germany . |
| 2460503 | 7/1976 | Fed. Rep. of Germany . |
| 3136349 | 8/1982 | Fed. Rep. of Germany . |
| 8319431 | 2/1984 | Fed. Rep. of Germany . |
| 3814831 | 10/1989 | Fed. Rep. of Germany . |
| 3836310 | 4/1990 | Fed. Rep. of Germany . |
| 3900818 | 5/1990 | Fed. Rep. of Germany . |
| 3911630 | 10/1990 | Fed. Rep. of Germany . |
| 3920821 | 1/1991 | Fed. Rep. of Germany . |
| 2225556 | 6/1990 | United Kingdom . |

*Primary Examiner*—Eugene H. Eickholt
*Attorney, Agent, or Firm*—Herbert L. Lerner; Laurence A. Greenberg

[57] ABSTRACT

Method and device for automatically and semi-automatically starting and stopping a sheet-turning operation and for sheet-format adjusting during sheet transport through a recto-and-verso printing press, wherein the sheets are singly transported in succession, by at least one transport drum, between two printing units, wherein, with the aid of remotely operated actuating and position-locking elements, gripper-control elements and sheet-holding segments of a storage drum are disposed so that sheets are transfered from the storage drum to a turning drum by the leading or trailing edge of the sheets, depending upon the mode of operation thereof, the grippers being, with respect to a suction device, adjusted to an appropriate sheet format. Adjustment of the sheet format can be performed both in recto-printing mode as well as in recto-and-verso printing mode.

3 Claims, 4 Drawing Sheets

METHOD AND DEVICE FOR STARTING AND STOPPING A SHEET TURNING OPERATION AND FOR FORMAT ADJUSTING DURING SHEET TRANSPORT THROUGH A PRINTING PRESS

The invention relates to a method and device for starting and stopping, especially automatically, a sheet-turning operation during the transport of sheets through a printing press, particularly the changeover of transport drums or cylinders between two printing units from single side or recto-printing mode to first form and perfector or recto-and-verso printing mode, and back again, as well as to sheet-size or format adjusting in both operating modes.

Printing presses have become known heretofore, from published German Patent Documents 24 19 747 C3, 39 11 609 Al, 39 20 821 Al, 39 11 630 Al, 39 00 818 Cl, 38 14 831 Cl, and 24 60 503 Al, for example, corresponding, respectively, to U.S. Pat. Nos. 4,122,773; 5,076,164; 5,085,143; 5,033,379; 5,105,737; 5,031,531; and 4,014,261, for printing on both sides of sheets in one pass, wherein a sheet-turning device is provided between two printing units, the sheet-turning apparatus being turned off during single-side or recto-printing mode and being turned on during first-form and perfector or recto-and-verso printing mode.

A printing press is described, for example, in the German Patent Document 24 60 503 C3 (U.S. Pat. No. 4,014,261), having a changeover and adjusting or setting device wherein, in single-side or recto-printing mode, a sheet oncoming from a preceding printing unit is accepted or received at the leading edge thereof by the grippers of a transfer drum and is passed on by the leading edge thereof to a first of two gripper systems of a storage drum having double the diameter of conventional printing-unit cylinders. The storage drum transfers the sheet, again by the leading edge thereof, to the grippers of a third drum which acts as the turning drum in first-for and perfector or recto-and-verso printing mode. All of the transport drums operate in synchronism, an operation which is realized by means of a drive with a closed gear train or by means of a drive with a plurality of mechanically decoupled motors having a regulated rotational speed. The gripper systems of the individual transport drums are cam-controlled, different gripper-opening cams being used in single-side or recto-printing mode and in first-form and perfector or recto-and-verso printing mode.

In contrast with single-side or recto-printing mode, the leading edge of the sheet, in first-form and perfector or recto-and-verso printing mode, is guided past the turning drum by the gripper system of the storage drum. The sheet is then gripped at the trailing edge thereof by the gripper system of the third drum, the gripper system of the third drum executing a 180-degree swiveling movement, and the gripper system of the storage drum releasing the leading edge of the sheet. The turned sheet is then passed on by the trailing edge thereof to a following printing unit for printing on the second side of the sheet. As the sheet is being transported on the storage drum, the sheet may be held and smoothly or tightly drawn by means of eccentric rotary suckers at the end of the sheet on the storage drum. Only at the instant of transfer is suction air at the rotary sucker shut off in an angle-controlled manner.

In general, the starting and stopping of the sheet-turning device requires the following method steps:

In a first step, the transport drums must be brought into a defined changeover position, which is referred to hereinafter as the zero position. Bringing the drums into the zero position is accomplished manually or via the drive of the printing press or via additional actuating drives. Attainment of the zero position is checked or controlled visually with reference to marks or scales or is detected by means of sensors which send an appropriate zero-position signal. Published German Patent Document 38 36 310 Al, for example, describes an arrangement for controlling switching operations on a printing press wherein an incremental-angle sensor is coupled with a gear transmission which drives the transport drums, the angle sensor transmitting, per revolution, a defined number of angle pulses as well as a single zero pulse having a leading side or flank which is used as the zero-position signal.

In a further step, the relative phase positions of the printing units are reset in that a part which is not to be rotated in the drive system of the printing press is held fast, and the remaining part of the drive system is rotated through a defined angle relative thereto. An extremely wide range of different restraining and locking mechanisms, respectively, are used as the means for holding the non-rotating part of the drive system fast. The main drive of the printing press or an additional actuating drive #may be employed as the actuating drive.

In a next step, the gripper-opening timings of the sheet-accepting and sheet-surrendering transport drums are reset in that, initially, the hold-fast or position-locking means of the gripper-control elements and of the gripper cam are released and, by means of separate drive elements, the gripper-control elements of the turning drum are displaced and the gripper cam of the storage drum is rotated.

In a further step, if required, the devices holding the trailing edges of the sheets may be set or adjusted, in accordance with the sheet size or format, to the trailing end of the respective sheet, on a transport drum serving as the storage drum, in that the held-fast or position-locking condition between these devices is released and in that the devices are reset, relative to the grippers holding the leading edge of the sheet, by a defined angle about a common shaft. All of the operating elements for effecting the position-locking or fast-holding conditions and all of the drive elements for the elements to be reset and all of the sensor elements for detecting the positions of the elements to be reset are connected to a control devices for controlling precise positioning.

For reasons of remote operation and automation, German Utility or Petty Patent (DE-GM) 83 19 431.2 and published German Patent Document 31 36 349 Al describe constructions wherein the release and start-up of position-locking or fast-holding means, as well as the drive for resetting the elements are effected by hydraulic devices. A disadvantage of this construction is that hydraulic fluid is required to be brought through rotating bushings or pass-throughs to the corresponding working cylinders, which rotate together with the transport drums. One or more separate pressure lines are provided for each switching and clamping operation, respectively, so that elaborate multiple rotating bushings are required. The switching, clamping and actuating or adjusting operations, respectively, may be performed from a central location, the control operations being performed successively in a defined sequence by means of a distributor-type switching device.

Consequently, these construction do not operate in an optimized timed manner.

A typical device for starting and stopping sheet-turning and for setting or adjusting sheet-size or format is described in German Patent 24 19 747. The changeover and setting or adjusting device disclosed therein includes a transfer drum of a delivery drum acting as a storage drum, and a turning drum. The changeover operation from single-side or recto-printing mode to first-form and perfector or recto-and-verso printing mode is made up of a basic changeover and a sheet-size or format setting or adjustment. For the basic changeover, the storage drum, inclusive altogether of the preceding printing units and, in synchronism therewith, a gripper-control cam of the storage drum for first-form and perfector or recto-and-verso printing mode are rotated, and a gripper-control cam of the storage drum for only the single-side or recto-printing mode are swung out of the way. For the sheet-size or format setting or adjustment, only the gripper-carrying part of the storage drum, including the preceding printing units, and the gripper-control cam for first-form and perfector or recto-and-verso printing mode are rotated. The part of the storage drum carried by the suckers and associated with the basic changeover of the turning drum is held fast or position-locked by a latch. After the basic changeover, the latch is inserted manually over a hook-in or suspension bolt disposed on the storage drum, and is lifted out again after the sheet format has been set. This operation requires an accurate positioning of the hook-in bolt, so that the latch can be inserted precisely. The positioning requires a precise attainment of the starting position and an accurate setting of the basic changeover angle for the basic changeover. For this purpose, the angle is fixed by a locking bolt. Furthermore, prior to the commencement of the changeover operation, the storage drum is set to a basic sheet-format position for a nominal sheet format, in order always to ensure a like positioning of the hook-in bolt in the starting position. If the suckers were used to locate the trailing edge of the sheet in the recto-printing mode, it is then necessary initially to adjust the drum to this basic sheet-format position. The setting of the sheet format in the recto-printing mode is performed manually on the storage drum itself with the aid of a mandrel, i.e., not as in recto-and-verso printing or perfecting mode, wherein the latch and a hand-operated adjusting crank together with a visually readable scale are used. A disadvantage of this construction is that a great number of actuating or adjusting operations take place which are not optimized as to time. Furthermore, the precise positioning of the hook-in bolt and the precise positioning of the storage drum into the starting position is difficult and/or costly. Moreover, care must be taken that the latch be inserted and lifted out, respectively, at the correct instant of time, after the basic changeover and after termination of sheet-format resetting or adjustment, respectively. This may result in changeover errors.

It is accordingly an object of the invention, to provide a method and device for starting and stopping a sheet-turning operation and for sheet-format adjusting, wherein rapid automatic starting and stopping and adjusting are achieved by relatively simple means.

With the foregoing and other objects in view, there is provided, in accordance with the invention, a method of starting and stopping a sheet-turning operation and for sheet-format adjusting during sheet transport through a first-form and perfector or a recto-and-verso printing press, wherein the sheets are singly transported in succession, by at least one transport drum, between two printing units; including, at a changeover of the printing press from recto-printing mode to recto-and-verso printing mode and back again and for sheet-format adjusting, starting from a changeover position, adjusting phase positions of printing units of the press with respect to one another by locking in position part of a drive system of the printing press which is not to be rotated, and rotating a remaining part of the drive system through a defined angle relative to the part locked in position; adjusting gripper-opening timings of sheet-accepting and sheet-surrendering transport drums in the printing press so that, in the recto-printing mode, sheets are surrendered and accepted by a leading edge thereof and, in recto-and-verso-printing mode, the sheets are accepted by a trailing edge thereof; if required for sheet-format adjusting, on a transport drum serving as a storage drum and having devices for holding the trailing edge of the sheets, adjusting the holding devices at the trailing end of the respective sheet in accordance with the sheet format by displacing the holding devices through a defined angle about a common shaft in relation to grippers holding the leading edge of the sheet; positioning and locating transport-drum elements which are to be moved in starting and stopping the sheet-turning operation and in sheet-format adjusting by means of a control device connected to actuating elements for the transport-drum elements and to sensor elements for detecting the positions of the transport-drum elements; which comprises starting the sheet-turning and adjusting the sheet format for recto-and-verso printing mode by, a) after attaining a zero position of the transport drums and after release of position-locking means between the part to be rotated and the part not to be rotated in the drive system of the printing press, between the devices for holding the trailing edge of the sheets and the grippers for holding the leading edge of the sheets of the storage drum and between the gripper-control elements and a frame of the printing press, bringing into a working position, by remote control, a latch of a two-sided asymmetrically acting latching mechanism for latching onto a bolt, the latch being swivelably attached to the frame of the printing press and being formed with a starting inclination, the bolt being attached to a part of the storage drum at which the holding devices for the trailing edge of the sheets are seated, the latch being spring-biased in a radial direction of the storage drum;

b) rotating the part to be rotated in the drive system of the printing press, with which the storage drum is associated, and the gripper-control elements of the storage drum together at least through a basic changeover angle and an angle dependent upon the sheet-format adjustment in recto-printing mode, until the latch latches onto the bolt;

c) for adjusting the sheet format, with the latch latched in position onto the bolt, the latch locking the holding devices for the trailing edge of the sheets in position, adjusting the part to be rotated and the gripper-control elements of the storage drum through a further angle so that the sheet-holding grippers and the devices for holding the trailing edge of the sheets assume positions appropriate to the respective sheet format;

d) restoring the released position-locking means to operation and bringing the latch by remote control into a rest position; and which comprises stopping the sheet-turning by, e) after reaching the vicinity of the zero position of the transport drums and after repeated release of the position-locking means, rotating the storage drum together with the gripper-control elements back through the basic changeover angle and the angle dependent upon the adjustment of the sheet format in verso-printing mode;

and which further comprises adjusting the sheet format in the recto-printing mode by, f) after release of the position-locking means between the devices for holding the trailing edge of the sheets and the grippers for holding the leading edge of the sheets on the storage drum, bringing the latch into the working position thereof;

g) rotating the storage drum until the latch latches in position onto the bolt;

h) with the latch latched in position onto the bolt, adjustingly displacing the part of the storage drum carrying the grippers through an angle so that the sheet-holding grippers and the devices for holding the trailing edge of the sheets assume the positions appropriate to the sheet format in the recto-printing mode; and i) restoring the position-locking means to operation and bringing the latch into the rest position thereof.

In accordance with another aspect of the invention, there is provided a device for starting and stopping a sheet-turning operation and for adjusting the format of a sheet during sheet transport through a printing press having a storage drum and a turning drum; drive means for adjusting relative phase positions of printing units of the printing press disposed before and after the turning drum, means for locking in position part of the drive means which is not to be adjusted; means for adjusting gripper-control elements of the storage drum and of the turning drum, position-locking means for fixing the turning-drum gripper-control elements and further position-locking means for fixing a storage-drum gripper cam, the turning-drum gripper-control elements being axially displaceable and the storage-drum gripper cam being rotatable about a shaft of the storage drum; means for adjusting two groups of elements for holding a leading edge and a trailing edge, respectively, of the sheets relative to one another about the shaft of the storage drum, means for locking the sheet-edge holding elements in position relative to one another, a bolt disposed in axial direction on means for carrying the elements for holding the trailing edges of the sheets, the bolt being associated with a latch of a latch-locking mechanism attached to a frame of the printing press; and a control device connected to the adjusting means and to sensor elements for detecting the positions of the adjustable elements relative to the non-adjustable elements; comprising:

j) a clutch disposed between the means for adjusting the gripper-control elements of the storage drum and the drive means for adjusting the relative phase positions of the printing units, the clutch having an operating element connected to a control part of the control device;

k) the latch being movable by remote control from a rest position into a working position and being formed at one end thereof with a starting inclination whereon the bolt is drivable as the storage drum is rotated in the printing-press running direction, and spring means for applying a biasing radial force to the latch when the latch is in the working position thereof;

l) and including a stop fixed to the frame and cooperatively engageable with the gripper-control element of the storage drum.

In accordance with a concomitant aspect of the invention, there is provided a method for starting and stopping a sheet-turning operation and for sheet-format adjusting during sheet transport through a first-form and perfector or a recto-and-verso printing press, wherein the sheets are singly transported in succession, by at least one transport drum, between two printing units; including, at a changeover of the printing press from recto-printing mode to recto-and-verso printing mode and back again and for sheet-format adjusting, starting from a changeover position, adjusting phase positions of printing units of the press with respect to one another by locking in position part of a drive system of the printing press which is not to be rotated, and rotating a remaining part of the drive system through a defined angle relative to the part locked in position; adjusting gripper-opening timings of sheet-accepting and sheet-surrendering transport drums in the printing press so that, in the recto-printing mode, sheets are surrendered and accepted by a leading edge thereof and, in recto-and-verso-printing mode, the sheets are accepted by a trailing edge thereof; if required for sheet-format adjusting, on a transport drum serving as a storage drum and having devices for holding the trailing edge of the sheets, adjusting the holding devices at the trailing end of the respective sheet in accordance with the sheet format by displacing the holding devices through a defined angle about a common shaft in relation to grippers holding the leading edge of the sheet; positioning and fixing transport-drum elements which are to be moved in starting and stopping the sheet-turning operation and in sheet-format adjusting by means of a control device connected to actuating elements for the transport-drum elements and to sensor elements for detecting the positions of the transport-drum elements;

which comprises starting the sheet-turning and manually adjusting the format for recto-and-verso printing mode, a) rotating the storage drum by means of the main motor of the printing press into a defined position wherein a bolt is disposed which is fastened to a part of the storage drum whereon the devices for holding the trailing edge of the sheets are also seated, as viewed in the press running direction before a latching position in a latch formed with a starting inclination swivelably attached to the frame of the printing press, the latch forming part of a two-sided asymmetrically operating latch-locking mechanism, b) releasing position-locking means between the devices for holding the trailing edge of the sheets and the grippers for holding the leading edge of the sheets, and bringing the latch into a capture position for the bolts, c) by means of the main motor of the printing press, rotating part of the storage drum carrying the grippers for holding the leading edge of the sheets into a position which at least corresponds to a maximum sheet format, initially rotating the storage drum altogether and, after rotating through a previously set format-dependent angle, the bolt engages in the latch so that the device for holding the trailing edge of the sheets are held fast in the engaging position, d) again placing into operation the position-locking means between the devices for holding the trailing edge of the sheets and the grippers for holding the leading edge of the sheets, bringing the latch into the starting position thereof, and rotating the storage drum and the printing press altogether approximately into the zero position by means of the main motor of the printing press, e) manually rotating the storage drum and the printing press altogether into the precise zero position with an adjusting device, and bringing an adjusting gear transmission into meshing engagement for adjusting gripper-opening times and the phase position of the printing units, thereby releasing and placing into operation, respectively, the position-locking means necessary for changeover, and bringing the latch again into the capture position thereof for the bolts, f) manually rotating, with the adjusting device, the storage drum altogether with the gripper control elements and the part of the printing press, which is to be rotated, through a basic changeover angle until the latch latches onto the bolts, which hold the devices holding the trailing edge of the sheets fast, whereby the gripper control of the turning drum simultaneously changed over, g) further manually rotating, with the adjusting device, the part of the storage drum carrying the grippers, together with the gripper-control elements and the part of the printing press, which is to be rotated, through a format-dependent angle until the respective format is attained, h) bringing the latch into the starting position thereof, again placing in operation and releasing, respectively, the position-locking means required for the changeover, and bringing out of engagement the adjusting gear transmission and the adjusting device, and which comprises stopping the sheet-turning, i) releasing the position-locking means between the parts of the storage drum, bringing the latch into capture position, slightly exceeding the zero position with the aid of the main motor until the latch latches onto the bolts, j) by means of the adjusting device, precisely attaining the zero position manually and bringing the adjusting gear transmission into meshing engagement, and releasing and placing into operation, respectively, the position-locking means required for stopping, k) rotating the part of the printing press to be rotated, the part of the storage drum which carries the grippers for holding the leading edge of the sheets, and the gripper-control elements through a format-dependent angle until a respective format is attained, bringing the latch into the starting position thereof, further rotating the part of the press to be rotated and the storage drum altogether together with the gripper control elements until the recto-printing position is reached, whereby the gripper control of the turning drum is simultaneously changed over, l) placing into operation and releasing, respectively, the position-locking means required for stopping, and disengaging the adjusting device and the adjusting gear transmission, and which comprises adjusting the format in recto-printing mode, m) bringing the latch into the working position thereof after releasing the position-locking means between the devices for holding the trailing edge of the sheets and the grippers for holding the leading edge of the sheets on the storage drum, and bringing the latch into the working position thereof, n) rotating the storage drum until the latch latches onto the bolts, o) with the latch latching onto the bolts, adjusting the gripper-carrying part of the storage drum through an angle so that the sheet-holding grippers and the devices for holding the trailing edge of the sheets assume the position corresponding to the sheet format to be used in the recto-printing, and p) placing the position-locking means again in operation, bringing the latch into the rest position thereof.

With the aid of the invention, it is no longer necessary for the storage drum or the bolt to be positioned with great accuracy, so that there is no need to expend any effort on precise positioning. Likewise, the adjustment of the storage drum to the basic format adjustment is inapplicable, and this is automatically adjusted, respectively.

The invention permits automatic adjustment of sheet format both in recto-and-verso printing mode and also only in recto-printing mode. Only one motor is required for change-over and/or adjustment or setting, it being possible to use the main motor of the printing press as long as the motor is situated before or upstream of the device according to the invention, as viewed in the sheet-transport direction. Apart from the sensor which detects the printing-press angle, no additional angle sensor is required if the angle transmitter is seated before the turn and has adequate accuracy.

By the coupled resetting or adjustment of the relative phase positions of the printing units and of the gripper-control elements as well as of the setting or adjustment of the sheet-holding elements to the appropriate sheet format, a correct angular relationship between all of the elements which are to be reset or adjusted is necessarily achieved. There is no need for separate detection of the resetting or adjusting angles or of the phase positions of the printing units or for the provision of an evaluation device for such detected values. Changeover errors are impossible due to the coupled and automatic sequence of operations.

The method also realizes a semi-automatic changeover device for perfector presses with the inclusion of the format adjustment of the storage drum in recto-printing mode. The last-described mode of the method operates likewise in a time-optimized manner, wherein in spite of less changeover steps being performed manually, changeover errors are eliminated. For semi-automatically performing the changeover operation, a manually operatable adjusting device is provided which permits turning of the storage drum together with the gripper-control elements and a part of the drive system of the printing press, so that the possibly additional servomotor for the fully automatic method may be dispensed with. The required angle-measuring system can be considerably less accurate because the precise positionings are performed manually.

Other features which are considered as characteristic for the invention are set forth in the appended claims.

Although the invention is illustrated and described herein as embodied in a method and device for starting and stopping a sheet-turning operation and for format adjusting during sheet transport through a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
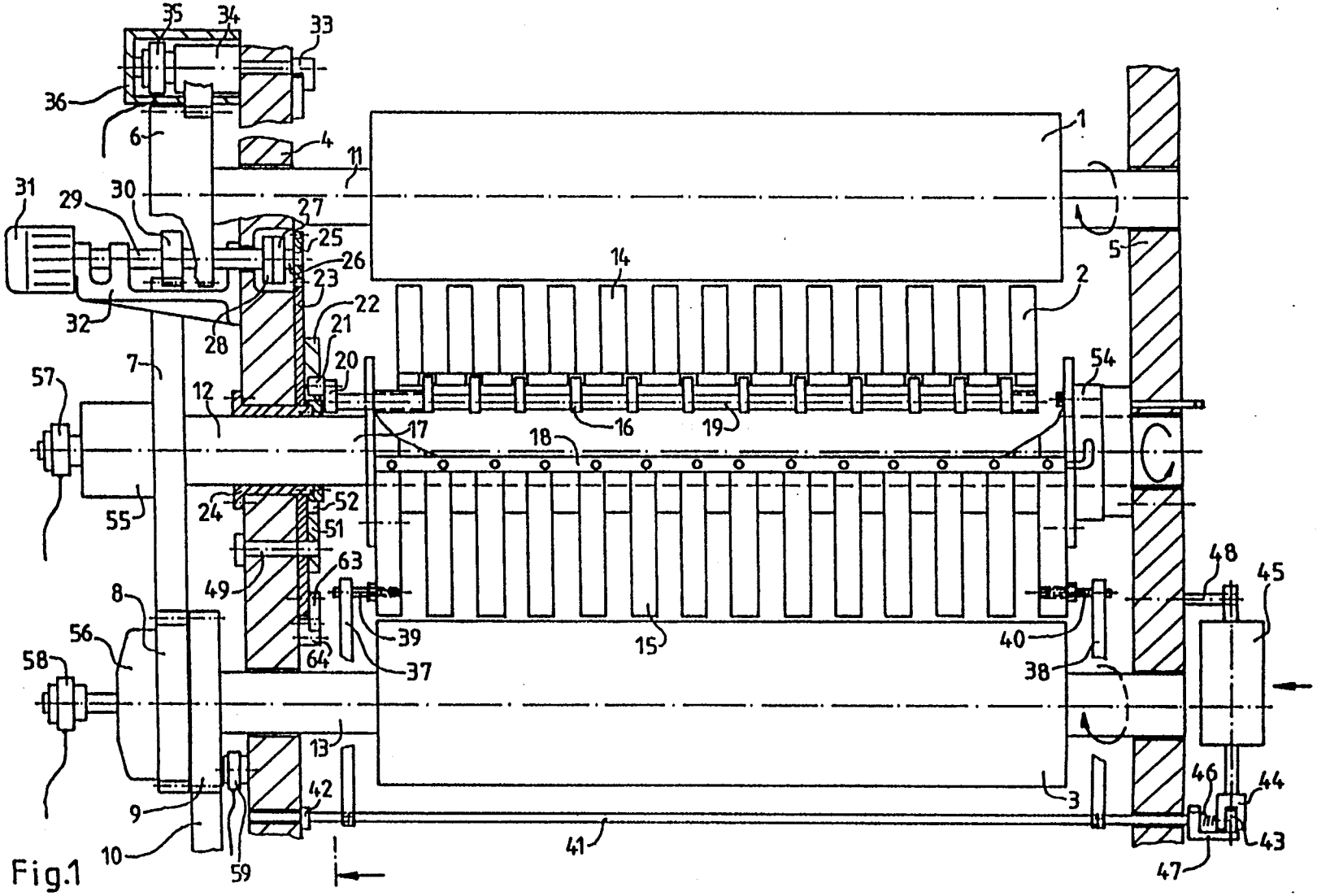
FIG. 1 is a diagrammatic side elevational view, partly in section, of a device for fully automatically starting and stopping a sheet-turning operation and for sheet-format or size adjusting in an arrangement with a transfer, a storage and a turning drum in a printing press.

Referring now to the drawings and, first, particularly to FIG. 1 thereof, there is shown therein diagrammatically a device for performing the method according to the invention. Illustrated in FIG. 1 are a transfer drum 1, a storage drum 2 and a turning drum 3, which are journalled in side walls 4 and 5 of a sheet-fed printing press, and are drivable by a gear transmission. The gear transmission is formed of a closed gear train having gearwheels 6 and 7, a ring gear 8 and gearwheels 9 and 10. The gearwheels 6, 7 and 9 are respectively fastened on shaft ends 11, 12 and 13, respectively, of the transfer drum 1, the storage drum 2 and the turning drum 3.

The storage drum 2 is formed of two sheet-supporting segments 14 and 15, of which the sheet-supporting segment 14, which carries grippers 16 for holding a respective leading edge of the sheets, is seated fixedly on a shaft 17, and the sheet-holding segment 15, which carries suction devices 18 for holding a respective trailing edge of the sheets, is disposed so as to be rotatable about the shaft 17 relative to the sheet-supporting segment 14.

The grippers 16 are disposed on a common gripper shaft 19, and a roller lever 20 with a cam roller 21 is fastened to a drive end of the gripper shaft 19. For control of the grippers 16, the cam roller 21 runs on a cam 22, which is mounted on a toothed segment 23. The toothed segment 23 is mounted on a bush or hub 24 so that it is rotatable about the shaft 17. For resetting or adjusting the toothed segment 23, including the cam 23, the teeth of the toothed segment 23 are engaged by or in meshing engagement with a pinion 25, which is mounted on a shaft 26 journalled in the side wall 4. Mounted on the shaft 26 is a clutch half 27 of a disc-type clutch, which is couplable or engageable with a second clutch half 28 whenever the cam 22 is to be rotated. The second clutch half 28 is seated on an actuating or adjusting shaft 29 having an actuating or adjusting pinion 30 mounted thereon, which is in meshing engagement with the gearwheel 7. The actuating shaft 29 is coupled with an actuating motor or servomotor 31, held by a mounting support 32 which is attached to the side wall 4. The toothed segment 23 pressable against the side wall 4 by means of a clamping jaw 33. The clamping jaw 33, which passes through the side wall 4, is part of a clamping device 34 having an hydraulic operating element 35 which are mounted together in a housing 36 fastened on the side wall 4.

The sheet-supporting segments 15 can be secured against rotation by means of two claws 37 and 38 and by means of bolts 39 and 40, respectively associated with the claws 37 and 38. The bolts 39 and 40 are attached to the sheet-supporting segments 15. The claws 37 and 38 are fixedly seated on a shaft 41, which is journalled in the side walls 4 and 5 and is secured against axial displacement by means of a disc 42 affixed thereto. The claws 37 and 38 can be brought from a rest position into a working position, for which purpose the shaft 41 is brought out through the side wall 5 and is connected to a lever 43 which, by means of a forked bolt 44 forming a piston rod of a pneumatic cylinder 45, is movable against a stop 47 against the force of a torsion spring 46. The pneumatic cylinder 45 is mounted on the side wall 5 by means of a fastening bolt 48.

Another control cam 51 for the grippers 16 is swivelably mounted on a bolt 49, which is anchored in the side wall 4 and projects through an oblong hole or slot 50 (FIG. 2) formed in the toothed segment 23. As can be seen in greater detail in FIG. 2, the control cam 51 is brought into the working position for single-side or recto-printing mode by running up onto a trip cam 52 mounted on the toothed segment 23. A swiveling-away of the control cam 51 is brought about by the force of a tension spring 53 mounted on the bush 24, the control cam 51 coming down from the trip cam 52. Control of the suction devices 18 is effected by means of control valves 54, which are seated laterally of the storage drum 2 on the shaft 17.

The clamped connections, respectively, between the sheet-supporting segments 14 and 15 and between the ring gear 8 and the gearwheel 9 can be released by means of clamping elements 55 and 56, which are controllable by hydraulic operating elements 57 and 58. Such clamping elements are described in greater detail, for example, in published German Patent Documents 36 11 352 Al and 40 04 352 Al. The gearwheel 9 can be fixed during the setting and changeover operation by means of an hydraulic position-locking or fast-holding element 59 mounted on the side wall 4. Provided for monitoring the setting and changeover operation are locally-fixed sensors 60, 61 and 62 (note FIGS. 2 and 3), which are directed towards the bolts 40 and towards a stop element 63 mounted on the toothed segment 23. The stop element 63 can run up onto a stop 64 mounted on the side wall 4.

Figure 2:
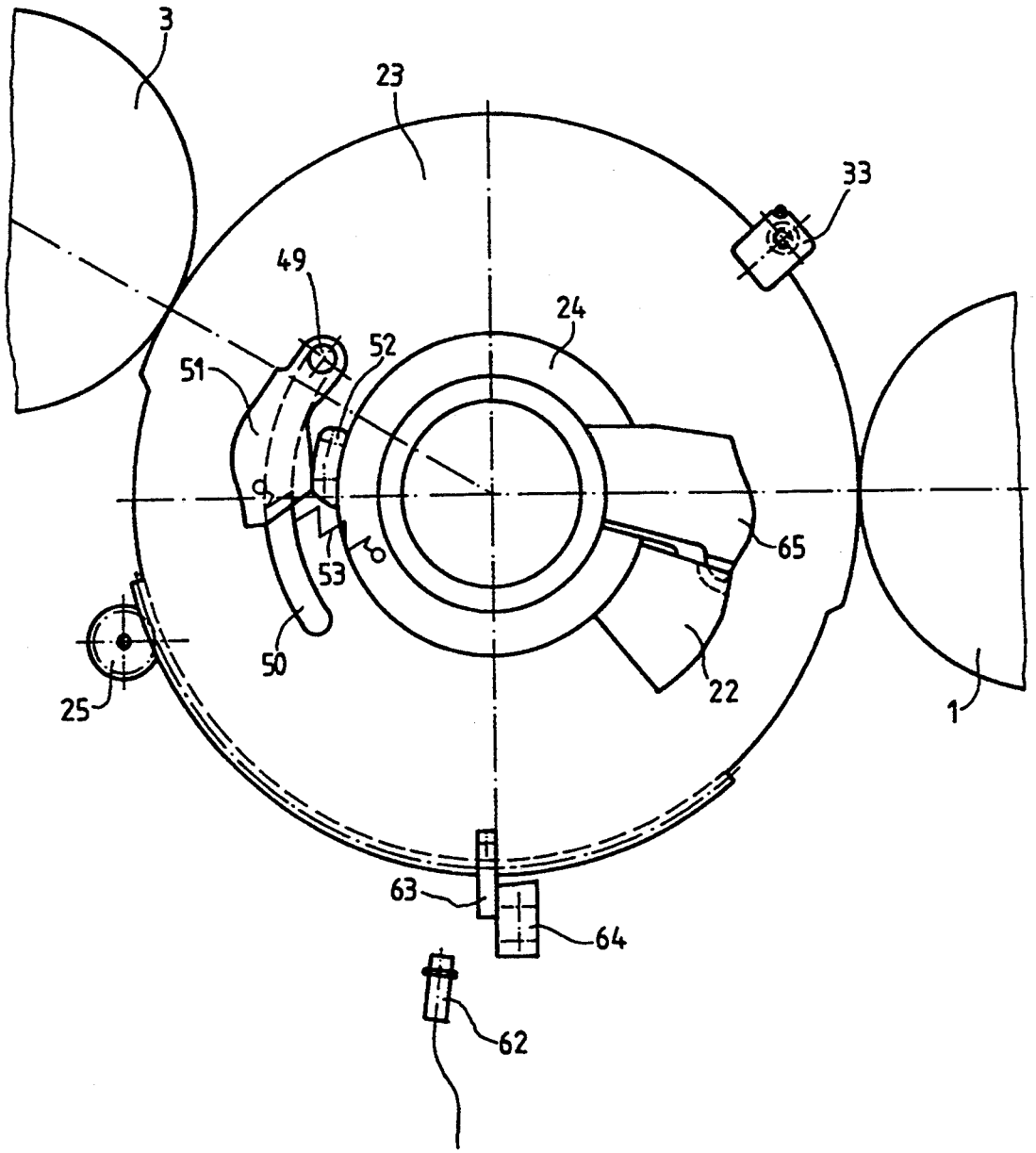
FIG. 2 is an enlarged fragmentary view of FIG. 1, in a different operating phase of the press, the storage drum having been omitted from the figure in the interest of clarity, as seen from the right-hand side of the transfer and turning drums in FIG. 1 and showing resetting or adjusting elements for gripper-control elements.

Provided in addition to the cam 22, which is adjustable by the toothed segment 23, and the swivelable-away control cam 51 is a further cam 65 which, as can be seen from FIG. 2, is fixedly disposed on the bush or hub 24. The cam 65 serves for controlling the operation of the grippers during transfer of a sheet from the transfer cylinder 1 to the storage drum 2 and requires no change in the position thereof in order to start and stop the sheet-turning operation or to set or adjust the sheet size or format. The changeover of the gripper control of the turning drum 3 is effected by a mechanical connection via an otherwise non-illustrated conventional mechanism.

With the aforedescribed arrangement, the fully automatic method according to the invention can be implemented as follows:

To start the sheet-turning operation and to set or adjust the sheet size or format for first-form and perfector or recto-and-verso printing mode, the transfer drum 1, the storage drum 2 and the turning drum 3 are driven into a so-called zero position with the aid of a drive, generally the main drive of the printing press. Furthermore, the hydraulic operating elements 35, 57 and 58 for the clamping elements 34, 55 and 56, respectfully, are subjected to pressure, so that the position-locking or fast-holding condition between the ring gear 8 and the gearwheel 9, as well as between the sheet-supporting segments 14 and 15, and the clamping of the toothed segment 23 against the side wall 4 are released. Simultaneously, the arresting or locking of the non-illustrated resetting or adjusting mechanism of the gripper control of the turning drum 3 is released by the operating element 58.

Figure 3:
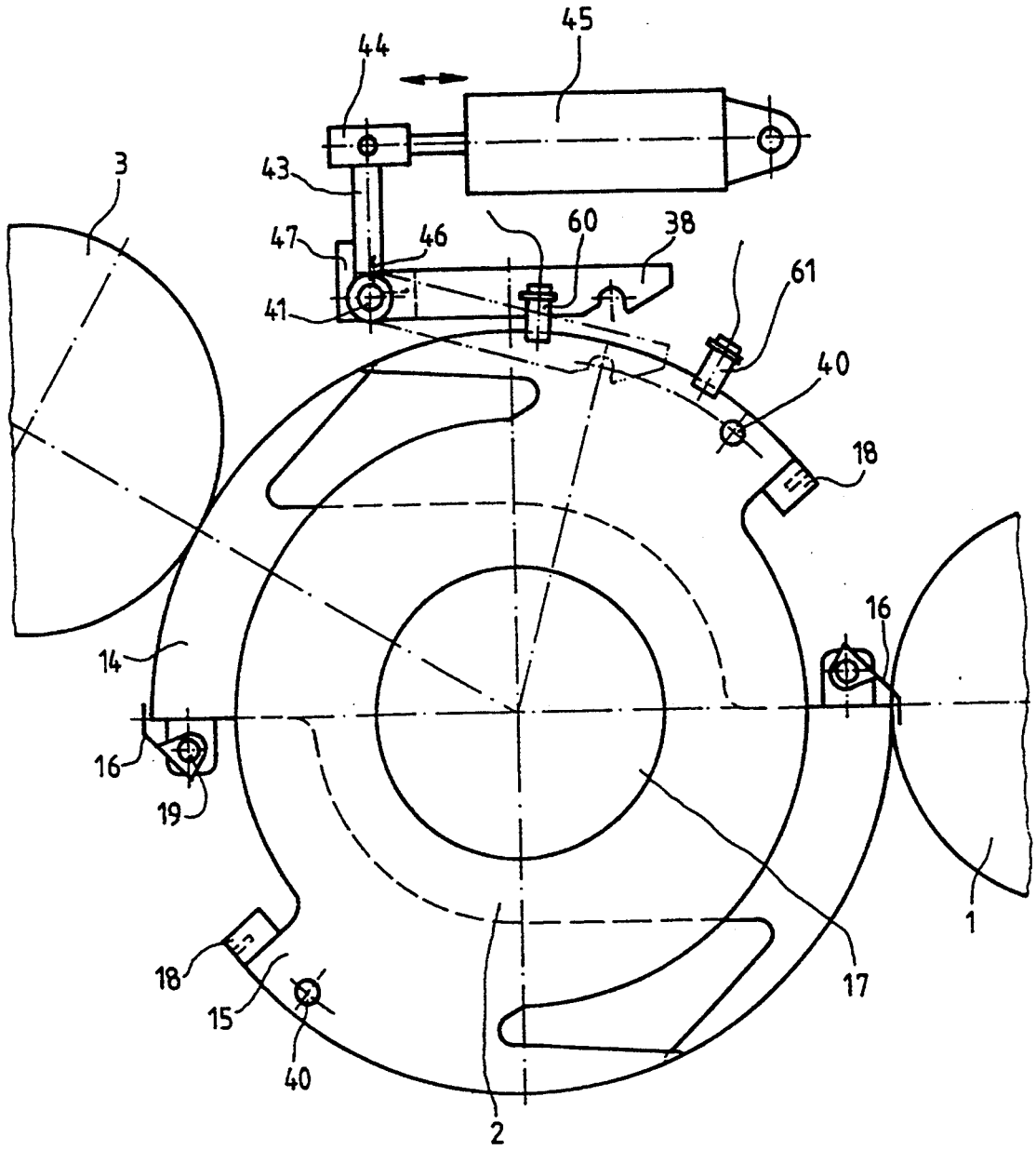
FIG. 3 is an enlarged fragmentary view of FIG. 1, in another different operating phase of the press, as seen from the left-hand side of the transfer, storage and turning drums, and showing auxiliary elements for the changeover and format setting operations.

In a further step, the pneumatic cylinder 45 is subjected to energizing pressure, so that, through the intermediary of the forked bolt 44, the lever 43 and the shaft 41, the claws 37 and 38 are brought from a rest position into a working position, as indicated in broken lines in FIG. 3. The claws 37 and 38 form latches or catches of a two-sided, asymmetrically acting latch-locking mechanism for accepting or receiving the bolts 39 and 40. In the working positions thereof, the claws 37 and 38 are subjected to the force of the torsion spring 46 in the radial direction of the storage drum 2.

In a next step, the actuating motor 31 is started, so that, through the intermediary of the actuating or adjusting pinion 30 and the pinion 25, the part to be rotated in the drive system of the printing press, and the cam 22 are rotated, in a direction opposite to the press running direction during printing, through at least a basic changeover angle plus an angle dependent upon the setting or adjustment of the sheet size or format in single-side or recto-printing mode, until the claws 37 and 38 latch onto the respective bolts 39 and 40. Simultaneously, the aforementioned otherwise non-illustrated conventional mechanism changes the gripper control of the turning drum 3 over. In the process, the position-locking or fast-holding element 59 is set into operation so that the gearwheels 9 and 10 and the turning drum 3 are not rotated therewith.

Furthermore, the sheet-size or format setting or adjustment for first-forth and perfector or recto-and-verso printing mode is performed in that, with the aid of the actuating motor 31, the part to be rotated in the drive system of the printing press, including the gearwheels 6 and 7, the ring gear 8, the transfer drum 1 and the sheet-supporting segments 14, and the toothed segment 23 with the cam 22 are further rotated in the printing-press running direction until the grippers 16 assume, with respect to the suction devices 18, the position appropriate to the sheet size or format. Because the claws 37 and 38 are latched onto the respective bolts 39 and 40, the sheet-supporting segments 15 are not adjusted therewith.

The sheet turning is stopped so that, in the aforementioned zero position of the transfer drum 1, the storage drum 2 and the turning drum 3, the position-locking or fast-holding condition between the sheet-supporting segments 14 and 15 and between the gearwheel 9 and the ring gear 10, as well as between the toothed segment 23 and the side wall 4, are again released, and so that the position-locking or fast-holding element 59 is set into operation. In this condition, the storage drum 2, together with the toothed segment 23 and the cam 22, is then turned back into the printing-press running direction until the stop element 63 makes contact with the stop 64. The printing press is then in first-side or recto-printing mode with the sheet-format setting for perfector or verso-printing mode.

To merely set the sheet size or format into single-side or recto-printing mode, it is necessary only to release the sheet-supporting segments 14 and 15 from the position-locking or fast-holding condition therebetween. There must be no engagement or coupling of the clutch halves 27 and 28 and no releasing of the clamping elements 55 and 56, as well as no locking of the turning drum 3 with the position-locking or fast-holding element 59. With the aid of the pneumatic cylinder 45, the claws 37 and 38 are brought into the working position thereof.

In a further step, the entire printing press, including the storage drum 2, is rotated with the aid of the main motor in the direction opposite to the press running direction until the claws 37 and 38 latch onto the respective bolts 39 and 40. Thereafter, with the respective claws 37 and 38 latched in position over or onto the bolts 39 and 40, the sheet-holding or supporting segments 14 are rotated with the aid of the main motor until the grippers 16 are, with reference to the suction device 18, in the position appropriate to the sheet size or format to be used in single-side or recto-printing mode.

After the setting and changeover operations, all of the released position-locking or fast-holding means are restored to operation, the position-locking or fast-holding element 59 is placed out of operation, the engagement between the clutch halves 27 and 28 is released, and the claws 37 and 38 are brought into the rest positions thereof. The sensors 60, 61 and 62 and the stop 64 with the stop element 63, as well as an otherwise non-illustrated angle-measuring system on the storage drum 2, serve to control the actuating motor or servomotor 31 and the main motor and to provide prescriptions for the angular range of adjustment, respectively, during the rotation of the sheet-supporting segments 14 and 15.

Figure 4:
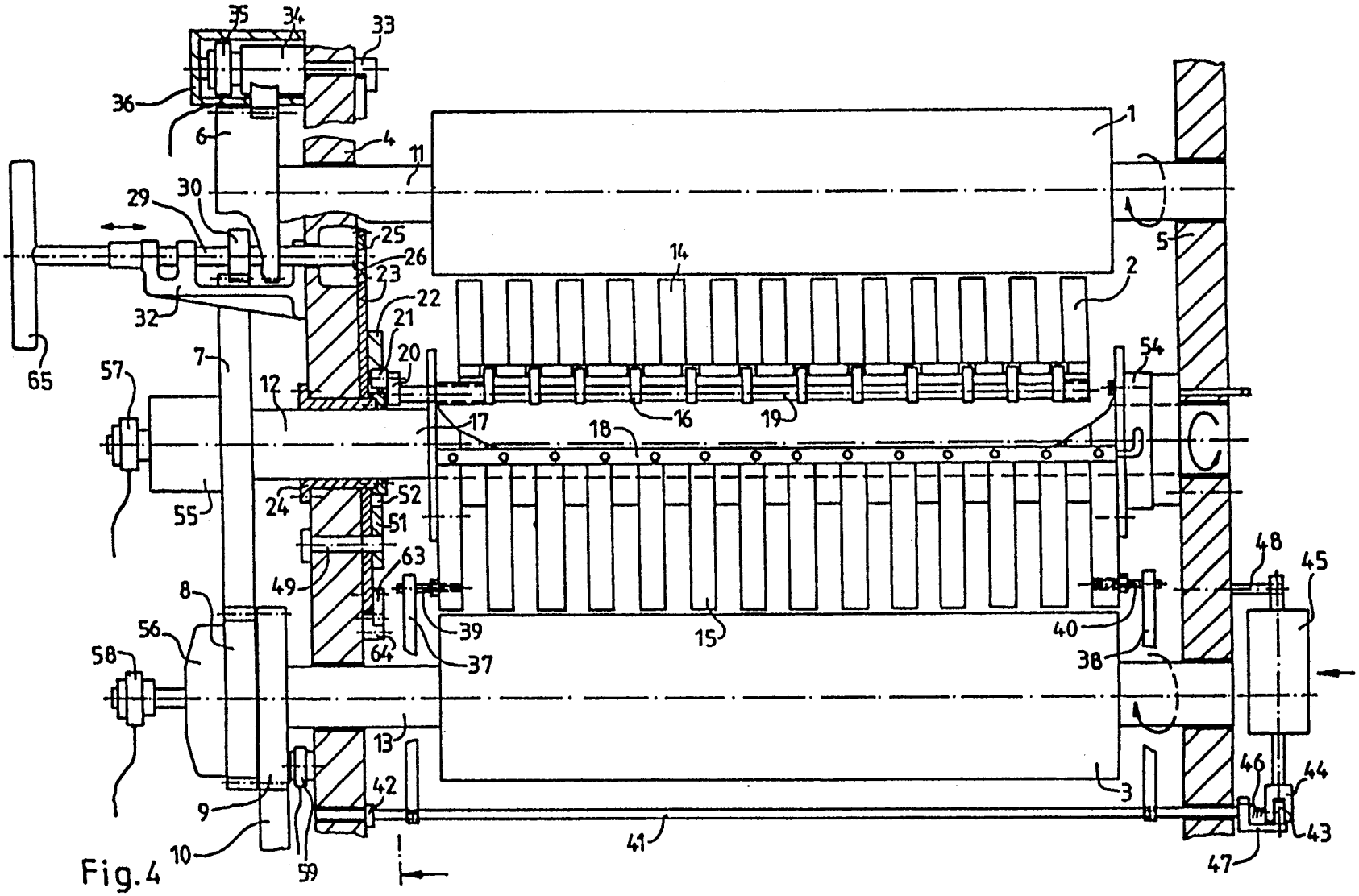
FIG. 4 is a view like that of FIG. 1 of another embodiment of the device according to the invention which operates semi-automatically.

The method according to the invention is capable of being performed semi-automatically, to which end, as shown in FIG. 4, the servomotor 31 is replaced by a crank handle 65, and the clutching engagement by the clutch halves 27 and 28 is unnecessary. The crank handle 65 is axially displaceable. In a first axial position thereof, the actuating or adjusting pinion 30 can be brought into meshing engagement with the gearwheel 7. In a second axial position of the crank handle 65, the pinion 25 can be brought into meshing engagement with the toothed segment 23, while the adjusting pinion 30 remains in meshing engagement with the gearwheel 7. As in the aforedescribed mode according to the invention, for format adjustment of the storage drum, a latch, preferably with the aid of a pneumatic cylinder, is brought into a working position, the latch being biased by spring force and being provide with a starting or run-up inclination. A semi-automatic mode of the method according to the invention is capable of being realized with the embodiment of the device according to the invention which is shown in FIG. 4.

Thus, the sheet turning operation is started and the format adjustment is performed manually as, in a first step, the storage drum 2 is rotated into a defined position by means of the main motor of the printing press. In this position, the bolts 39 and 40, as viewed in the press running direction, are located in front of the position wherein they are latched onto by the respective latches 37 and 38. In a further step, the position-locking or fast-holding condition between the sheet-supporting segments 14 and 15 is released by means of the actuating element 57, and the latches 37 and 38 are brought into a position wherein they catch or latch onto the bolts 39 and 40, respectively, by means of the pneumatic cylinder 45. Thereafter, the sheet-supporting segments 14 with the grippers 16 are rotated into a position which at least corresponds to the maximum sheet format, whereby, initially, the storage drum 2 altogether is rotated and, after the rotation through an angle dependent upon a previously set format, the bolts 39 and 40 engage in the respective latches 37 and 38 and, thereby, the sheet-supporting segments 15 are held fast or locked in position. Then, the position-locking or fast-holding condition is set into operation again between the sheet-supporting segments 14 and 5, the latches 37 and 38 are brought into the starting position thereof, and the storage drum and nearly the entire press, respectively, are rotated into the zero position by the main motor. After the crank handle 65 has engaged in the first position, positioning occurs hereinafter into the precise zero position by means of the crank handle 65. Thereafter, the crank handle 65 is displaced in axial direction into the second position and, via the toothed segment 23, the pinion 25 and the actuating or adjusting pinion 30, the instant of time at which the gripper openings occur in the storage drum 2 and the phase positions of the printing units are adjusted, the corresponding position-locking or fast-holding having been released and having been set into operation, respectively, and the latches 37 and 38 having been newly brought into a position for capturing or latching onto the respective bolts 39 and 40, beforehand. In the course thereof, the storage drum 2 initially all told together with the cam 22 and the part in the drive system of the printing press to be rotated about a basic changeover angle are rotated until the latches 37 and 38 latch onto the respective bolts 39 and 40, whereby the sheet-supporting segments 15 are locked in position or held fast. Thereafter, hereinaforementioned elements are rotated by the crank handle 65 through a format-dependent angle until the desired format is attained. Simultaneously, the gripper control of the turning drum 3 is adjusted.

As a last step when starting the sheet-turning operation and the manual format-adjusting, the latches 37 and 38 are again brought into the starting position thereof, and the necessary position-locking or fast-holding is again set into operation and released, respectively, and the crank handle 65 with the actuating or adjusting pinion 30 and the pinion 25 are again brought out of engagement by axial displacement.

To stop the sheet-turning operation, the position-locking or fast-holding condition between the sheet-supporting segments 14 and 15 is discontinued, the latches 37 and 38 are brought into the capture position and the aforementioned zero position is slightly exceeded by the main motor until the latches 37 and 38 latch onto the respective bolts 39 and 40. Then, with the aid of the crank handle 65, the zero position is precisely arrived at manually. Thereafter, the position-locking or fast-holding condition is released or discontinued and set into operation, respectively, the crank handle 65 having been brought into the second position beforehand. Then, the part in the drive system of the printing press which is to be rotated and the sheet-supporting segments 14, as well as the toothed segment 23, are rotated through a format-dependent angle until the desired format for the single-sheet or recto-printing mode is attained. The latches 37 and 38 are then brought into the starting position thereof and the storage drum 2 altogether and the toothed segment 23 together with the part in the drive system of the press which is to be rotated and the gripper control elements are rotated further until the single-sheet or recto-printing position is reached. In this connection, the gripper control of the turning drum 3 is simultaneously changed over. The stoppage of the sheet-turning operation is accordingly terminated so that the position-locking or fast-holding condition necessary for the stoppage are set into operation and are discontinued, respectively, and the crank handle 65 is disengaged.

If only one format adjustment is to be made in the single-sheet or recto-printing mode, the latches 37 and 38 are then initially brought into the capture position and the fast-holding or position-locking condition between the sheet-supporting segments 14 and 15 is discontinued, after which the storage drum 2 and the press altogether, respectively, are rotated until the latches 37 and 38 latch onto the respective bolts 39 and 40. In the next step, the sheet-supporting segments 14 are adjusted through a defined angle so that the grippers 16 and the suction devices 18 assume a position corresponding to the sheet format to be used in single-side or recto-printing. Finally, the fast-holding or position-locking condition is again placed in operation, and the latches 37 and 38 are brought back into the rest position thereof.

I claim:

1. Method of starting and stopping a sheet-turning operation and for sheet-format adjusting during sheet transport through a first-form and perfector or a recto-and-verso printing press, wherein the sheets are singly transported in succession, by at least one transport drum, between two printing units;

including, at a changeover of the printing press from recto-printing mode to recto-and-verso printing mode and back again and for sheet-format adjusting, starting from a changeover position, adjusting phase positions of printing units of the press with respect to one another by locking in position part of a drive system of the printing press which is not to be rotated, and rotating a remaining part of the drive system through a defined angle relative to the part locked in position;

adjusting gripper-opening timings of sheet-accepting and sheet-surrendering transport drums in the printing press so that, in the recto-printing mode, sheets are surrendered and accepted by a leading edge thereof and, in recto-and-verso-printing mode, the sheets are accepted by a trailing edge thereof;

if required for sheet-format adjusting, on a transport drum serving as a storage drum and having devices for holding the trailing edge of the sheets, adjusting the holding devices at the trailing end of the respective sheet in accordance with the sheet format by displacing the holding devices through a defined angle about a common shaft in relation to grippers holding the leading edge of the sheet;

positioning and locating transport-drum elements which are to be moved in starting and stopping the sheet-turning operation and in sheet-format adjusting by means of a control device connected to actuating elements for the transport-drum elements and to sensor elements for detecting the positions of the transport-drum elements;

which comprises starting the sheet-turning and adjusting the sheet format for recto-and-verso printing mode by, a) after attaining a zero position of the transport drums and after release of position-locking means between the part to be rotated and the part not to be rotated in the drive system of the printing press, between the devices for holding the trailing edge of the sheets and the grippers for holding the leading edge of the sheets of the storage drum and between the gripper-control elements and a frame of the printing press, bringing into a working position, by remote control, a latch of a two-sided asymmetrically acting latching mechanism for latching onto a bolt, the latch being swivelably attached to the frame of the printing press and being formed with a starting inclination, the bolt being attached to a part of the storage drum at which the holding devices for the trailing edge of the sheets are seated, the latch being spring-biased in a radial direction of the storage drum;

b) rotating the part to be rotated in the drive system of the printing press, with which the storage drum is associated, and the gripper-control elements of the storage drum together at least through a basic changeover angle and an angle dependent upon the sheet-format adjustment in recto-printing mode, until the latch latches onto the bolt;

c) for adjusting the sheet format, with the latch latched in position onto the bolt, the latch locking the holding devices for the trailing edge of the sheets in position, adjusting the part to be rotated and the gripper-control elements of the storage drum through a further angle so that the sheet-holding grippers and the devices for holding the trailing edge of the sheets assume positions appropriate to the respective sheet format;

d) restoring the released position-locking means to operation and bringing the latch by remote control into a rest position;

and which comprises stopping the sheet-turning by, e) after reaching the vicinity of the zero position of the transport drums and after repeated release of the position-locking means, rotating the storage drum together with the gripper-control elements back through the basic changeover angle and the angle dependent upon the adjustment of the sheet format in verso-printing mode;

and which further comprises adjusting the sheet format in the recto-printing mode by, f) after release of the position-locking means between the devices for holding the trailing edge of the sheets and the grippers for holding the leading edge of the sheets on the storage drum, bringing the latch into the working position thereof;

g) rotating the storage drum until the latch latches in position onto the bolt;

h) with the latch latched in position onto the bolt, adjustingly displacing the part of the storage drum carrying the grippers through an angle so that the sheet-holding grippers and the devices for holding the trailing edge of the sheets assume the positions appropriate to the sheet format in the recto-printing mode; and i) restoring the position-locking means to operation and bringing the latch into the rest position thereof.

2. Device for starting and stopping a sheet-turning operation and for adjusting the format of a sheet during sheet transport through a printing press having a storage drum and a turning drum; drive means for adjusting relative phase positions of printing units of the printing press disposed before and after the turning drum, means for locking in position part of the drive means which is not to be adjusted;

means for adjusting gripper-control elements of the storage drum and of the turning drum, position-locking means for fixing the turning-drum gripper-control elements and further position-locking means for fixing a storage-drum gripper cam, the turning-drum gripper-control elements being axially displaceable and the storage-drum gripper cam being rotatable about a shaft of the storage drum;

means for adjusting two groups of elements for holding a leading edge and a trailing edge, respectively, of the sheets relative to one another about the shaft of the storage drum, means for locking the sheet-edge holding elements in position relative to one another, a bolt disposed in axial direction on means for carrying the elements for holding the trailing edges of the sheets, the bolt being associated with a latch of a latch-locking mechanism attached to a frame of the printing press; and a control device connected to the adjusting means and to sensor elements for detecting the positions of the adjustable elements relative to the non-adjustable elements;

comprising j) a clutch disposed between the means for adjusting the gripper-control elements of the storage drum and the drive means for adjusting the relative phase positions of the printing units, the clutch having an operating element connected to a control part of the control device;

k) the latch being movable by remote control from a rest position into a working position and being formed at one end thereof with a starting inclination whereon the bolt is drivable as the storage drum is rotated in the printing-press running direction, and spring means for applying a biasing radial force to the latch when the latch is in the working position thereof;

l) and including a stop fixed to the frame and cooperatively engageable with the gripper-control element of the storage drum.

3. Method for starting and stopping a sheet-turning operation and for sheet-format adjusting during sheet transport through a first-form and perfector or a recto-and-verso printing press, wherein the sheets are singly transported in succession, by at least one transport drum, between two printing units;

including, at a changeover of the printing press from recto-printing mode to recto-and-verso printing mode and back again and for sheet-format adjusting, starting from a changeover position, adjusting phase positions of printing units of the press with respect to one another by locking in position part of a drive system of the printing press which is not to be rotated, and rotating a remaining part of the drive system through a defined angle relative to the part locked in position;

adjusting gripper-opening timings of sheet-accepting and sheet-surrendering transport drums in the printing press so that, in the recto-printing mode, sheets are surrendered and accepted by a leading edge thereof and, in recto-and-verso-printing mode, the sheets are accepted by a trailing edge thereof;

if required for sheet-format adjusting, on a transport drum serving as a storage drum and having devices for holding the trailing edge of the sheets, adjusting the holding devices at the trailing end of the respective sheet in accordance with the sheet format by displacing the holding devices through a defined angle about a common shaft in relation to grippers holding the leading edge of the sheet;

positioning and fixing transport-drum elements which are to be moved in starting and stopping the sheet-turning operation and in sheet-format adjusting by means of a control device connected to actuating elements for the transport-drum elements and to sensor elements for detecting the positions of the transport-drum elements;

which comprises starting the sheet-turning and manually adjusting the format for recto-and-verso printing mode, a) rotating the storage drum by means of the main motor of the printing press into a defined position wherein a bolt is disposed which is fastened to a part of the storage drum whereon the devices for holding the trailing edge of the sheets are also seated, as viewed in the press running direction before a latching position in a latch formed with a starting inclination swivelably attached to the frame of the printing press, the latch forming part of a two-sided asymmetrically operating latch-locking mechanism, b) releasing position-locking means between the devices for holding the trailing edge of the sheets and the grippers for holding the leading edge of the sheets, and bringing the latch into a capture position for the bolts, c) by means of the main motor of the printing press, rotating part of the storage drum carrying the grippers for holding the leading edge of the sheets into a position which at least corresponds to a maximum sheet format, initially rotating the storage drum altogether and, after rotating through a previously set format-dependent angle, the bolt engages in the latch so that the device for holding the trailing edge of the sheets are held fast in the engaging position, d) again placing into operation the position-locking means between the devices for holding the trailing edge of the sheets and the grippers for holding the leading edge of the sheets, bringing the latch into the starting position thereof, and rotating the storage drum and the printing press altogether approximately into the zero position by means of the main motor of the printing press, e) manually rotating the storage drum and the printing press altogether into the precise zero position with an adjusting device, and bringing an adjusting gear transmission into meshing engagement for adjusting gripper-opening times and the phase position of the printing units, thereby releasing and placing into operation, respectively, the position-locking means necessary for changeover, and bringing the latch again into the capture position thereof for the bolts, f) manually rotating, with the adjusting device, the storage drum altogether with the gripper control elements and the part of the printing press, which is to be rotated, through a basic changeover angle until the latch latches onto the bolts, which hold the devices holding the trailing edge of the sheets fast, whereby the gripper control of the turning drum simultaneously changed over, g) further manually rotating, with the adjusting device, the part of the storage drum carrying the grippers, together with the gripper-control elements and the part of the printing press, which is to be rotated, through a format-dependent angle until the respective format is attained, h) bringing the latch into the starting position thereof, again placing in operation and releasing, respectively, the position-locking means required for the changeover, and bringing out of engagement the adjusting gear transmission and the adjusting device, and which comprises stopping the sheet-turning, i) releasing the position-locking means between the parts of the storage drum, bringing the latch into capture position, slightly exceeding the zero position with the aid of the main motor until the latch latches onto the bolts, j) by means of the adjusting device, precisely attaining the zero position manually and bringing the adjusting gear transmission into meshing engagement, and releasing and placing into operation, respectively, the position-locking means required for stopping, k) rotating the part of the printing press to be rotated, the part of the storage drum which carries the grippers for holding the leading edge of the sheets, and the gripper-control elements through a format-dependent angle until a respective format is attained, bringing the latch into the starting position thereof, further rotating the part of the press to be rotated and the storage drum altogether together with the gripper control elements until the recto-printing position is reached, whereby the gripper control of the turning drum is simultaneously changed over, l) placing into operation and releasing, respectively, the position-locking means required for stopping, and disengaging the adjusting device and the adjusting gear transmission, and which comprises adjusting the format in recto-printing mode, m) bringing the latch into the working position thereof after releasing the position-locking means between the devices for holding the trailing edge of the sheets and the grippers for holding the leading edge of the sheets on the storage drum, and bringing the latch into the working position thereof, n) rotating the storage drum until the latch latches onto the bolts, o) with the latch latching onto the bolts, adjusting the gripper-carrying part of the storage drum through an angle so that the sheet-holding grippers and the devices for holding the trailing edge of the sheets assume the position corresponding to the sheet format to be used in the recto-printing, and p) placing the position-locking means again in operation, bringing the latch into the rest position thereof.

* * * * *